United States Patent [19]

Campanaro et al.

[11] 4,004,801

[45] Jan. 25, 1977

[54] ISOTONIC EXERCISE UNIT

[76] Inventors: Thomas J. Campanaro, 6840 Convoy Court, San Diego, Calif. 92111; Douglas E. Marino, 2023 Red Coach Lane, Encinitas, Calif. 92024

[22] Filed: June 13, 1975

[21] Appl. No.: 586,734

[52] U.S. Cl. ..... 272/120; 128/DIG. 5; 403/14; 403/364; 272/134

[51] Int. Cl.[2] ..... A63B 21/00

[58] Field of Search ..... 272/79 R, 58, 80, 72, 272/81, 56.5 R, 134, 120; 220/18; 403/378, 364, 361, 14, 13; 128/DIG. 15

[56] References Cited

UNITED STATES PATENTS

| | | | |
|---|---|---|---|
| 1,750,549 | 3/1930 | Thomson et al. | 272/79 R X |
| 1,983,790 | 12/1934 | Brooks | 403/364 X |
| 3,263,994 | 8/1966 | Londgren | 272/56.5 R |
| 3,366,381 | 1/1968 | Ross | 272/59 C |
| 3,535,719 | 10/1970 | Murcott | 128/DIG. 15 X |
| 3,658,327 | 4/1972 | Thiede | 272/79 R |
| 3,729,113 | 4/1973 | Lopatka | 220/18 |
| 3,892,404 | 7/1975 | Martucci | 272/134 |

*Primary Examiner*—Paul E. Shapiro
*Assistant Examiner*—William R. Browne

[57] ABSTRACT

The invention is an exercise unit having a pair of rigidly connected spaced rails being elevatable at one end to a selectable height to define an incline, and a flat carriage rollable on said rails and having structure including pulley lines and a foot retainer for drawing the carriage and the body of the user upward along the incline by the physical exertion of the user. The rails are separable into upper and lower halves and are connected together in use by a novel tongue and socket structure reinforced with a hook and rod system. On the rails a foot grip is mounted so as to be freely pivotable during an exercise program.

5 Claims, 12 Drawing Figures

ISOTONIC EXERCISE UNIT

BACKGROUND OF THE INVENTION

The invention is in the field of physical fitness and exercise units and particularly relates to portable units for use in the home.

The benefits to the body of a regular program of physical exercise have become increasingly apparent, and this awareness has spawned the development and marketing of numerous exercise devices to be used in conjunction with or as a substitute for natural exercises such as jogging, running, bicycling and swimming. One of these devices is disclosed in U.S. Pat. No. 3,658,327, in which the user situates himself on a platform disposed on an inclined plane and reciprocates his body weight up and down the incline with his arms by means of a rope and pulley system, or by engaging his feet in a foot strap jointed to the frame and using his legs.

The general concept of the above referenced unit is excellent, and permits the user to specifically stress an enormous number of muscles in a surprising variety of positions without loading the heart more than is desired. However, in spite of these advantages certain features of the unit limit its utility. Salient among these design drawbacks are the foot strap structure, which has been found to be quite abrasive to the feet, which are strapped to an unyielding platform, and the fact that in its implemented embodiment the bulk of the structure comprises two inseparable hinged halves rendering it heavy and difficult for a lightweight person to move.

SUMMARY OF THE INVENTION

The present invention comprises an inclined plane isotonic exercise unit which is free of the abovementioned disadvantages and comprises two plane-defining rails elevated to one of several possible levels at one end and being completely separable centrally to an upper and lower half to permit the carrying of individual pieces of the unit separately, the two halves being joined in use by a unique tongue and socket joint reinforced by a collateral hook and rung structure which renders the unit extremely strong and capable of supporting quite a heavy person. A platform or carriage is roller-mounted on the rails, and a cable pulley system may be used alternatively with a swivel foot grip mounted between an upper portion of the rails to permit the user to raise himself with his arms or legs, respectively. The swivel foot grip rotates freely to accommodate the anatomy of the user as his legs alternately bend and straighten during the exercise so that his feet are secured in comfort and no chaffing occurs. A second swivel foot grip can be optionally mounted to the lower end of the rail to promote blood circulation in the legs and accommodate other needs of patients undergoing rehabilitation therapy for certain leg ailments.

The lower ends of the rails are also provided with outwardly directed grip bars which can be engaged by the hands or feet to repel the user up the incline, and a collapsible elevation stand is used to raise one end of the rail structure to a selected level.

DETAILED DESCRIPTION OF THE PREFERRED EMBODIMENT

Figure 1:
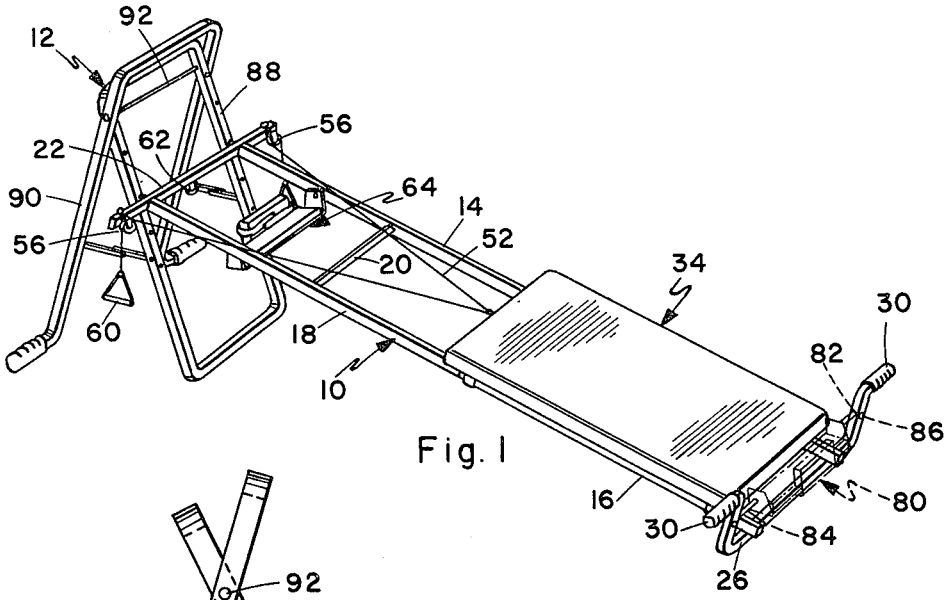
FIG. 1 is a perspective view of the complete apparatus.

A general understanding of the structure and operation of the unit can be obtained by examining the perspective view of FIG. 1 of the drawings, in which an elongated frame 10 is shown resting on a floor or other surface at the lower end and elevated on a stand 12 at the other end. The frame 10 includes a pair of parallel rails 14 and is separable into a lower half 16 and an upper half 18. The rails are preferably rectangular in cross section as shown and constitute galvanized or chrome plated steel tubing. A pair of cross members 20 are welded between the rails generally centrally in both frame halves and additional lateral rigidity is provided by a cross bar 22 spanning the upper ends of the rails and having extended ends 24, and a lower cross bar 26 spans the lower end of the rails and has doubly-bent ends 28 terminating in horizontal foot or hand support members which are covered with plastic or rubber hand grips 30. Two spanner rods 32 are welded between the rails on the two respective halves adjacent the junction thereof.

Figure 10:
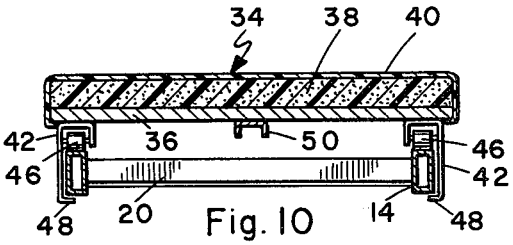
FIG. 10 is a sectional view taken on line 10—10 of FIG. 9.

Disposed above the frame 10 is a platform-type carriage 34 having a rigid planar backing 36 covered with a layer of foam rubber 38 or other suitable padding and enclosed in a plastic or vinyl cover 40, which in the simplest form of the invention may be stapled around the edges to the underside of the backing 36 of plywood composition. Four brackets 42 are mounted beneath the panel 36 near the ends and on opposite sides thereof. These brackets are formed of bent metal stampings and each has an axle pin 44 mounted therein which supports in journalled relationship roller wheels 46 as best seen in FIG. 10. These rollers ride on the flat upper surfaces of the rectangular rails 14, and to prevent lateral slippage and vertical separation of the platform relative to the frame, each of the brackets 42 also has a planar depending guide 48 inwardly bent at its lower extremity, these guides normally paralleling the respective surfaces of the rails and being slightly spaced therefrom. To further strengthen the carriage a longitudinally extended inverted U-beam 50 is screwed to the underside of the panel 36 as shown in FIG. 10.

It is clear from the above description that the carriage 34 is free to roll up and down on the rails 14, and in normal operation the user situates himself on this carriage in various positions and by using his arms and legs in one of several manners repeatedly propels himself upwardly on the incline. One way in which this can be done is by repelling from the hand grips 30, which can obviously be done with either the arms or legs.

Another method of reciprocating the carriage involves the use of the lines 52, preferably plastic coated steel cables which attach to the upper edge of the carriage at an eyebolt 54, pass through pulleys 56 which are secured in eyebolts 58 mounted on the extensions 25 of the upper crossbar, and terminate in handles 60, which are gripped by the user. An additional eyebolt 62 may be mounted centrally on the crossbar 20 for the attachment of a single pulley and line for use by persons having only one arm. It has been found that a one-armed user can best use the pulley system without becoming unbalanced if the pulley is centrally located.

Figure 3:
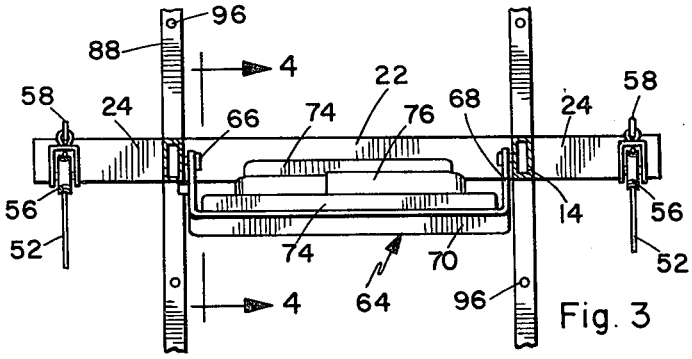
FIG. 3 is a sectional view taken on line 3—3 of FIG. 2.

Yet another means provided for drawing the user upward is the rocker-type swivel foot grip 64 detailed in FIG. 3. The foot grip is pivoted between upper rail portions on inwardly projecting stub axles 66 which are capped to capture side flanges 68 of a cradle having a sheet metal plate 70 which supports the feet behind the heels and an orthogonal extension 72 which rests against the soles of the feet. The foot grip is padded as at 74 along its foot-contacting surfaces and a pair of straps 76 are fastened behind the padding and are preferably provided with interengagable strips of Velcro to permit quick securement of the feet.

Figure 4:
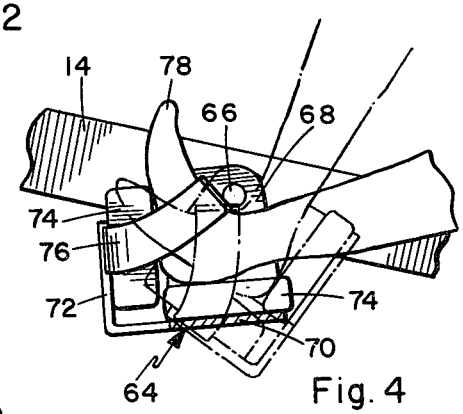
FIG. 4 is an enlarged sectional view taken on line 4—4 of FIG. 3.
Figure 5:
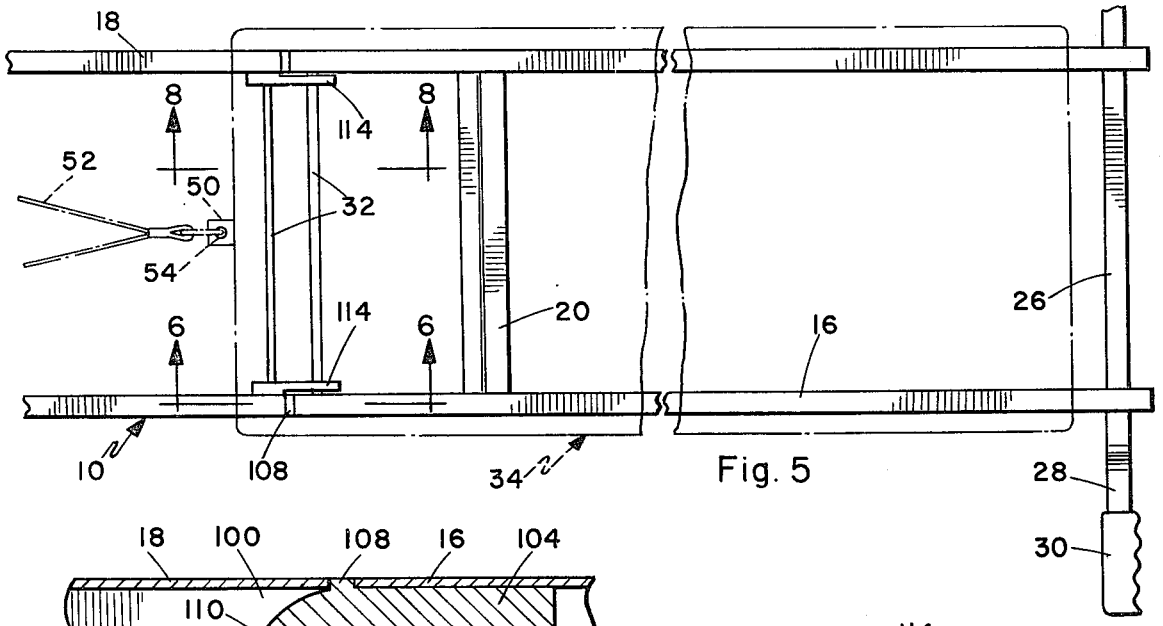
FIG. 5 is a top plan view of the lower end of the apparatus.

FIG. 4 illustrates the movement of the foot grip in use. The user's feet, indicated at 78, are placed in the cradle and strapped down, the user lying on his back on the carriage. By bending the legs the body is raised up the incline, and as the angle of the lower legs and feet varies the foot cradle accommodates the change so that no pain or discomfort is experienced. The foot grip can also be used to secure the feet during sit-up exercises.

Another foot grip similar to foot grip 64 is shown in phantom in FIG. 1 at 82. This foot grip is attachable at the user's option between the uprights of the crossbar 26, which are optionally provided with holes 82 which seat trunnion-type pins 84 extending from the foot grip. Pull-pins 86 are inserted in bores in the ends of the trunnion pins to removably secure the cradle in position. This second foot grip is an option that is used to secure the feet of a person with partially or totally paralyzed legs to enable him to more easily exercise his chest, arms, and shoulders and at the same time promote leg circulation.

Figure 2:
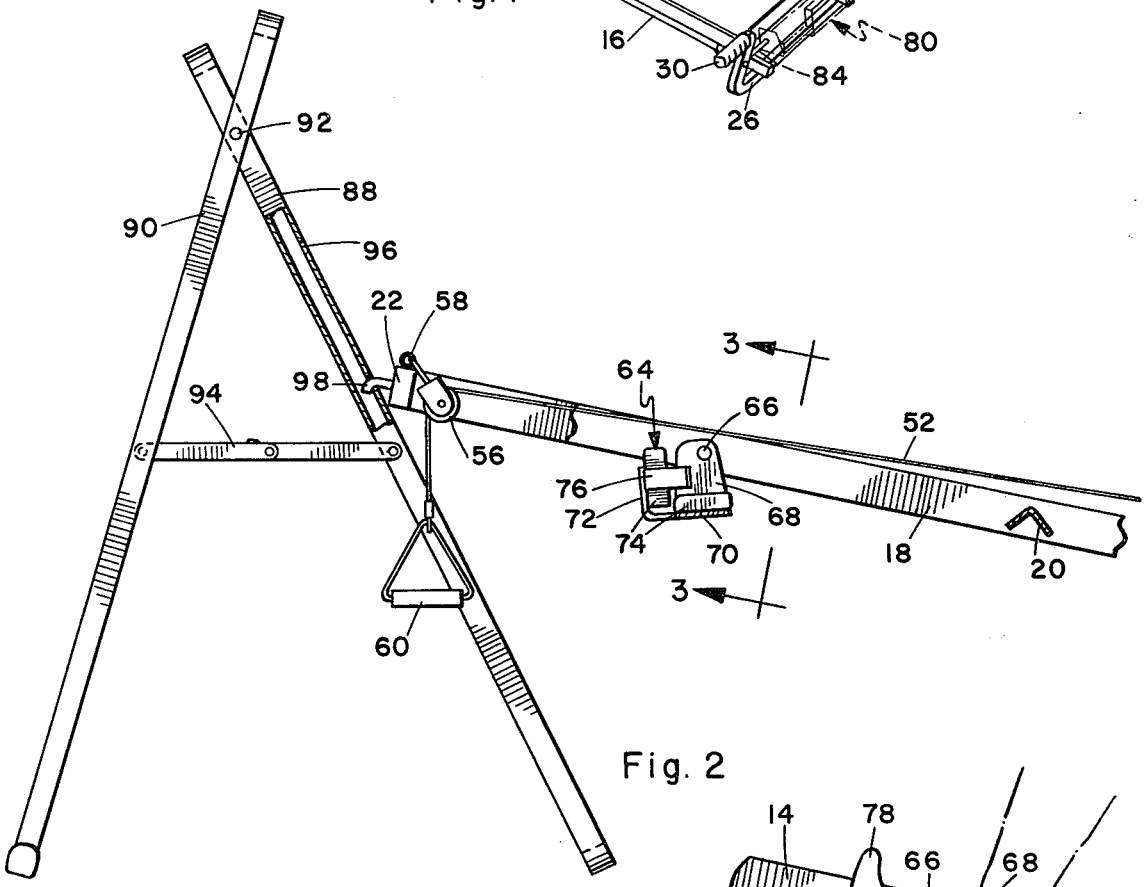
FIG. 2 is an enlarged side elevation view of the raised end, with portions cut away.

The stand 12, best shown in FIGS. 1 and 2, comprises a continuous frame member 88 which is connected to a second frame 90 by an axle rod 92 or the equivalent. A pair of knee braces 94 pivoted to the sides of the frame members about halfway down limit the angle of expansion of the stand when open and permit the collapsing of the frames into substantially planar form which can be visualized by studying FIGS. 1 and 2.

Frame member 88 is hollow and punctured along its side members to form a plurality of holes 96 defining horizontal pairs. These hole pairs are selectively engaged by hooks 98 which extend from the upper crossbar 22 opposite the junctions of the rails with the crossbar, as shown in FIGS. 1 and 2 that the upper end of the rail structure is elevatable to one of several selected levels.

Figure 6:
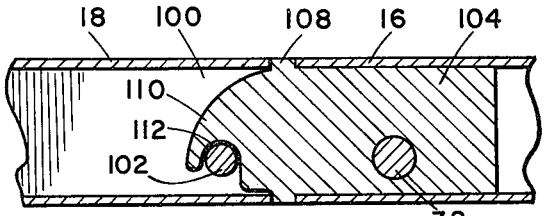
FIG. 6 is an enlarged sectional view taken on line 6—6 of FIG. 5.
Figure 7:
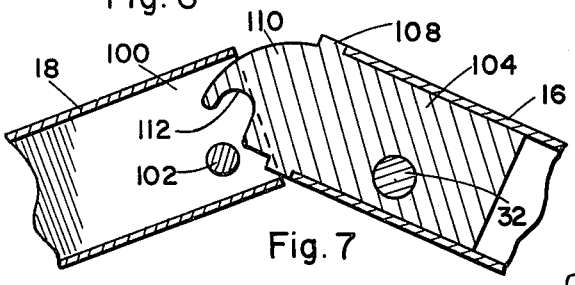
FIG. 7 is a view similar to FIG. 5, showing the joint action.
Figure 8:
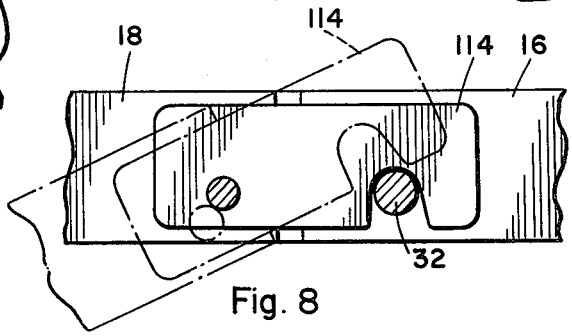
FIG. 8 is an enlarged sectional view taken on line 8—8 of FIG. 5.
Figure 9:
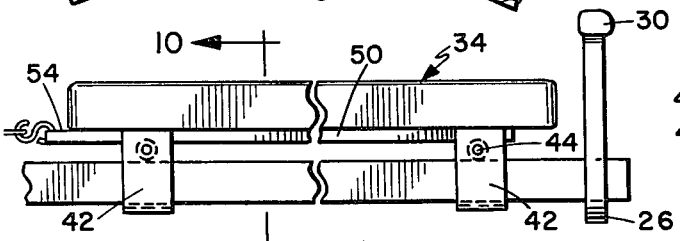
FIG. 9 is a side elevation view of the lower end of the apparatus.

As mentioned above, the rails 14 are separable into lower and upper half frames 16 and 18 to facilitate transportation and storage of the unit. A simple means has been provided to join the two halves together to invest the structure when mated with the needed strength without increasing the width dimension of the rails. As shown in FIGS. 6–8 the mating ends of the upper half frame are hollow as at 100 and each is provided with a transverse pin 102 near the opening thereof. The complementary mating ends of the rails of the lower half frame each have a plug 104 snugly secured therein and form extensions of the rails having a collar 108 flush with the external surfaces of the rails and a projecting end portion 110 which is rounded at its upper surface and provided with a slightly arcuate slot or notch 112 at its lower end. The two half frames are thus matable by inserting the plugs 104 into the hollow sockets 100 at an angle as shown in FIG. 7 and then straightening the halves out to define a plane as shown in FIG. 6, so that the slots 112 are engaged on the pins 102. It can thus be seen that downwardly directed forces on the joint force the plugs into more secure engagement with the pins, and by lifting up on the joint the plugs disengage the pins and the two halves can be separated.

To further strengthen the joint, and again without increasing the width dimensions of the rails, a pair of elongated hooks 114 are welded to the inner side of the mating ends of the upper rails and extend across the rail junctions to engage one of the rods 32. As shown in FIG. 8, engagement of the rod by the hooks is accomplished automatically and simultaneously with the engagement of the plugs on the pins.

Figure 11:
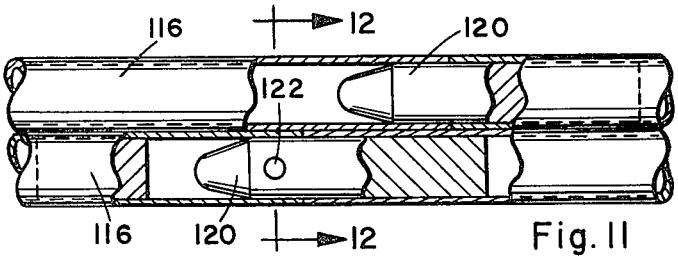
FIG. 11 is a side elevation view, partially cut away, of an alternative joint.
Figure 12:
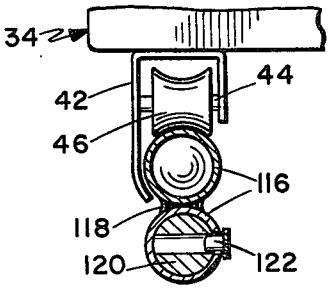
FIG. 12 is a sectional view taken on line 12—12 of FIG. 11.

A slight modification of the rail and joint structure is shown in FIGS. 11 and 12 in which the rails comprise a pair of parallel tubular members 116 which are welded together as at 118, the rollers 46 having a concave surface to ride smoothly on the circular tubular surface. The lower half of this tube structure includes cylindrical projections 120 which extend beyond the mating ends of the tubes and engage the hollow ends of the tubes of the other half frame. The projections may be secured in the mating tubes by means of a pull pin 122 so that again the two halves of the unit are easily separable, and as shown in FIG. 11, the mating ends of the tubes comprising each rail may be staggered relative to one another to provide greater strength.

The exercise device constructed as described above is lightweight, portable and inexpensive in comparison to other exercise systems, and permits the exercising of virtually all the major muscles of the body for purposes of therapy or general body toning.

We claim:

1. An exercise unit comprising:

a. a pair of parallel rails;

b. cross members mounted to and between said rails to maintain same in spaced relation;

c. a carriage having rollers engaged on said rails whereby said carriage is easily movable along the substantial length thereof;

d. means for maintaining one end of said rail pair at an elevation relative to the other end thereof;

e. a foot grip freely pivotable on the rails during an exercise operation, and said grip being positioned between said pair of rails near the elevated end thereof and having releasible strap means for retaining the feet therein;

f. said foot grip comprising a pair of generally orthogonally related cradle-forming padded plates, the first of which plates normally being disposed beneath the sole portions of the feet of the user and the second of said plates extending behind the heels of the user and substantially covering same whereby a person lying on said carriage can engage his feet in said foot grip and draw himself upward along said rails by pulling with the back of his heels against the second of said plates.

2. Structure according to claim 1 wherein said strap means comprises a pair of straps each being mounted at one end thereof to said swivel foot grip and having mutually engageable Velcro fasteners on portions thereof, whereby the feet of a user can be securely retained by said straps in said foot grip.

3. An exercise device comprising:

a. two mating half frames, each having a pair of parallel rail portions thereon defining a pair of continuous linear rails when said half frames are mated;

b. the mating ends of each of the rail portions of one of said half frames terminating in a hollow socket and each socket having a transverse laterally extended pin mounted therein;

c. the mating ends of the rail portions of the other of said half frames each including a hook which extends into one of said sockets and engages the pin therein, whereby said mating half frames are joinable to define a continuous elongated frame in which said continuous linear rails are smooth along the upper and lower surfaces thereof at the mating points of said rail portions, said hook being completely contained within said sockets when mated, each said hook forming a portion of the smooth and continuous connection between the two mating frames.

4. Structure according to claim 3 wherein each of said rails comprises a pair of mating halves one of which defines a socket having a transverse pin therein and the other of said halves having an extension dimensioned to extend into said socket and being provided with a slightly arcuate slot to accept said pin whereby said rail halves are mated by placing said extensions into said sockets at an angle and bringing said half frames into a generally planar relation such that downward pressure on said rails brings said rail portions into longitudinally tighter mating relation.

5. Structure according to claim 3 and including, in addition to said hooks and pins, a rod extending between the rail portions of one of said half frames near the mating end thereof and a pair of hooks extending from the mating ends of the rails of the other of said half frames to engage said rod when said half frames are mated.

* * * * *